United States Patent [19]

Sjöbom

[11] 4,129,263

[45] Dec. 12, 1978

[54] DEVICE FOR REFINING FIBROUS MATERIAL

[75] Inventor: Axel H. Sjöbom, Njurunda, Sweden

[73] Assignee: Sunds Aktiebolag, Sundsvall, Sweden

[21] Appl. No.: 829,452

[22] Filed: Aug. 31, 1977

[30] Foreign Application Priority Data

Sep. 9, 1976 [SE] Sweden ..... 7609973

[51] Int. Cl.[2] ..... B02C 7/11

[52] U.S. Cl. ..... 241/248; 241/251

[58] Field of Search ..... 241/244, 245, 247, 248, 241/249, 251

[56] References Cited

U.S. PATENT DOCUMENTS

| | | | |
|---|---|---|---|
| 783,022 | 2/1905 | Colley | 241/251 |
| 829,792 | 8/1906 | Kramer | 241/248 X |
| 1,046,019 | 12/1912 | Reynolds | 241/248 X |
| 2,214,707 | 9/1940 | Markley | 241/251 |
| 2,560,826 | 7/1951 | Schuhmann | 241/245 X |

*Primary Examiner*—Howard N. Goldberg

*Attorney, Agent, or Firm*—Lerner, David, Littenberg & Samuel

[57] ABSTRACT

Apparatus for refining fibrous materials is disclosed, including first and second refining discs defining a refining space therebetween, a passageway for feeding fibrous material to said refining space from the outer surface of one of said refining discs, a funnel for feeding fibrous material to the outer surface of that refining disc at a first rate, and including an element mounted on the shaft on which said refining discs rotate for injecting the fibrous material into the passage at an increased velocity as compared to that rate. Preferably the element mounted on the shaft comprises a sleeve and includes an annular disc mounted on the sleeve and a plurality of radially projecting members affixed to the face of the annular disc facing the passage through the refining disc.

14 Claims, 4 Drawing Figures

1
2
3
4
5
6
7
8
9
10
11
12
a
b
c
d
α
II
II 9
3
10
11
12

12
11'
10

12
11''
10

DEVICE FOR REFINING FIBROUS MATERIAL

FIELD OF THE INVENTION

This invention relates to double disc refiners for refining fibrous material. Such refiners comprise two contra-rotating refining discs where the material is refined while it is passed through the gap between the discs. The fibrous material is supplied in the form of chips through openings located close to the centre of one refining disc.

BACKGROUND OF THE INVENTION

During the refining operation great amounts of steam are generated which to a certain extent pass out of the refiner together with the refined material, but a large part of the steam flows rearward to the chip feed. This steam flow can disturb the chip feed flow so that it becomes non-uniform, which implies that also the refining result will be non-uniform.

The chip feed usually is carried out by means of a screw or the like, which rotates at uniform speed and thereby feeds the material toward the openings in one refining disc. The feed speed then is low, normally about 2 m/s, and if, besides, the feed passageway has a small cross-section, the rearward flow of the steam can disturb the chip feed.

SUMMARY OF THE INVENTION

The present invention solves this problem by means of a special device, which is intended to impart to the chips at their feed into the openings in one refining disc a high flow speed. Due to the high speed, at which the material is thrown toward the openings in the refining disc, the feed is not disturbed by the steam flow, but a uniform material flow can be maintained.

More particularly, in accordance with this invention this problem may be solved by means of an apparatus which comprises first and second refining discs, each of which includes an inner refining surface and an outer surface, and each of which is further mounted on shafts for rotation relative to each other with the inner refining surfaces opposing each other during such relative rotation to define a refining space therebetween. The fibrous materials can thus be refined by passing radially outwardly within that refining space, and the apparatus includes means for feeding the fibrous material to the refining space including passage means extending from the outer surface of the first refining disc to the refining space at a point adjacent to the shaft on which the first refining disc is mounted, means for feeding the fibrous material to the outer surface of the first refining disc at a first rate, and means mounted on the shaft on which the first refining disc is mounted for rotating therewith for injecting the fibrous material into the passage means at an increased velocity as compared to that first rate.

In a preferred embodiment, means mounted on the shaft comprises a sleeve, and includes an annular disc mounted on that sleeve, and a plurality of radially projecting members affixed to the face of the annular disc facing the passage means.

Preferably, the radially projecting members have a substantially triangular cross-section and preferably extend from the sleeve to the outer periphery of the annular disc.

In a particularly preferred embodiment the sides of the radially projecting members having substantially triangular cross-sections are at an angle of between about 30° and 120° with respect to the annular disc.

BRIEF DESCRIPTION OF THE DRAWINGS

The invention is described in greater detail in the following, with reference to the accompanying drawing, in which.

DETAILED DESCRIPTION

Figure 1:
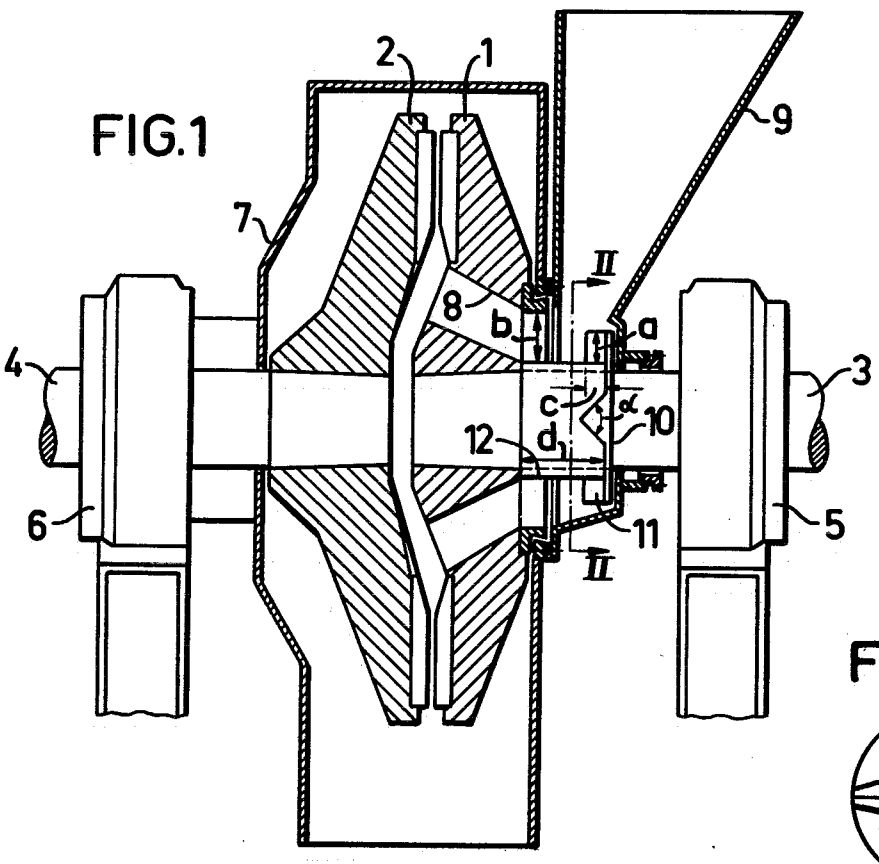
FIG. 1 is a side, partial sectional view of the device according to the invention

FIG. 1 shows a double disc refiner according to the invention. Two contra-rotating refining discs 1, 2 are located each on a shaft 3, 4 which are driven individually by motors (not shown). The bearings 5, 6 located closest to the refining discs are shown in the Figure. About the refining discs 1, 2 a housing 7 is provided to collect the material, which after refining flows out from the gap between the refining discs.

One refining disc 1 is provided close to the centre with openings 8 for the feed of material to be refined. Directly in front of these openings 8, the housing is open about the shaft 3 and connected to a feed funnel 9 for guiding the chips to the opening in the housing. The chips are fed down into the funnel 9 in a uniform flow by means of a batching device (not shown), for example in the form of a sluice feeder or a screw.

Directly in front of the openings 8 in the refining disc 1 a radial disc sleeve 10 is provided which is rotary together with the shaft 3. The disc is located at some distance from the refining disc 1, so that the funnel 9 opens into the space between the refining disc 1 and the disc sleeve 10.

The disc sleeve 10 is provided with at least two substantially radial mouldings 11 directed to the openings 8 in order to throw the chips with high speed into the openings 8 of the refining disc 1. The flanks of the mouldings 11 are inclined, preferably so that the mouldings have a triangular cross-section, but they may also have another shape, depending, for example on the number of revolutions of the disc sleeve 10 and the chip size.

According to the embodiment shown, the disc sleeve 10 and the mouldings 11 are attached to a sleeve 12 surrounding the shaft 3 and extending all the way to the refining disc 1. The flanks of the mouldings 11 constitute an angle $\alpha$, where $\alpha$ is 10°–170°, preferably 30°–120° and preferentially about 90°. The flank surfaces of the mouldings can be plane, concave, convex or circular.

Figure 2:
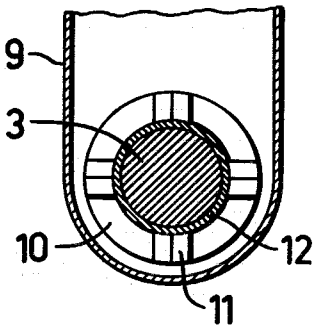
FIG. 2 is a front sectional view taken along line II—II of FIG. 1
Figure 3:
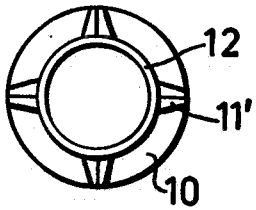
FIG. 3 is a front prospective view of an alternative feed device in accordance with the present invention.
Figure 4:
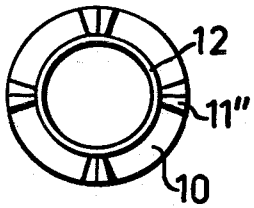
FIG. 4 is a front, prospective view of another alternative feed device in accordance with the present invention.

The ratio between the radial extension, a, of the mouldings 11 and the radial extension, b, of the openings 8, should be 0.1–1.0, preferably 0.25–0.75 and preferentially about 0.5. The ratio between the axial extension, c, of the mouldings 11 and the distance, d, from the disc sleeve 10 to the openings 8 should be 0.1–0.7, preferably 0.2–0.4 and preferentially about 0.25. Normally the breadth of each moulding 11 is equal along its radial extension (FIG. 2). But in certain cases it could be suitable to design the mouldings broader at the sleeve 12 than at the periphery of the disc sleeve 10 (FIG. 3) of vice versa (FIG. 4). These mouldings are referred to as 11' and 11'', respectively. The number of mouldings can vary from 2 to 20, preferably from 3 to 6 but preferentially 4 mouldings are used.

At the refining operation, the disc sleeve 10 rotates at the same number of revolutions as the refining disc 1, usually 1000–1800 rpm, which implies that the chips dropping down through the funnel 9 are subjected to impacts from the mouldings 11 and thereby are thrown into the openings 8 in the refining disc 1. The chips when entering the openings 8 are acted upon by the centrifugal force and advanced into the space between the refining discs 1, 2.

In certain cases it could be advantageous to combine the device according to the present invention with a device according to U.S. Patent Application Serial No. 829,179.

The invention is not restricted to the embodiment shown, but can be varied within the scope of the idea of the invention.

I claim:

1. Apparatus for refining fibrous material which comprises first and second refining discs, said refining discs including an inner refining surface and an outer surface, said refining discs mounted on shafts for rotation relative to each other with said inner refining surfaces opposite each other during said relative rotation so as to define a refining space therebetween, so that said fibrous material can be refined by passing radially outward within said refining space, means for feeding said fibrous material to said refining space comprising passage means extending from the outer surface of said first refining disc to said refining space, said passage means being located at a point adjacent to said shaft on which said first refining disc is mounted, feed means for feeding said fibrous material to said outer surface of said first refining disc at a first rate, said feed means including a discharge end, and means mounted on said shaft on which said first refining disc is mounted for rotation therewith for injecting said fibrous material into said passage means at an increased velocity as compared to said first rate, said means mounted on said shaft on which said first refining disc is mounted being located at a point spaced from said outer surface of said first refining disc and said discharge end of said feed means being located between said means mounted on said shaft and said passage means.

2. The apparatus of claim 1 wherein said feed means for feeding said fibrous material to said outer surface of said first refining disc at a first rate comprises funnel means for guiding said fibrous material whereby said first rate is determined by gravity.

3. The apparatus of claim 1 wherein said means mounted on said shaft includes a plurality of radially projecting members having a substantially converging cross-section with the point to which said cross-section converges facing said passage means.

4. The apparatus of claim 3 wherein said means mounted on said shaft includes sleeve means, an annular disc mounted on said sleeve, said annular disc including an inner surface and an outer surface, said inner surface being mounted on said sleeve means and said outer surface located a distance radially outward from said inner surface, and wherein said plurality of radially projecting members are affixed to the face of said annular disc.

5. The apparatus of claim 4 wherein said radially projecting members extend from said sleeve means to said outer surface of said annular disc.

6. The apparatus of claim 4 wherein said sleeve means extends from said annular disc to a point adjacent said outer surface of said first refining disc.

7. The apparatus of claim 4 wherein the ratio of the length of said radially projecting members measured in an axial direction to the distance between said annular disc and said passage means is from about 0.1 to 0.7.

8. The apparatus of claim 3 wherein said radially projecting members have a substantially triangular cross-section.

9. The apparatus of claim 8 wherein said triangular cross-section of said radially projecting members includes sides which are at an angle of between about 30° and 120° with respect to each other.

10. The apparatus of claim 8 wherein said triangular cross-sections of said radially projecting members include sides which are at an angle of about 90° with respect to each other.

11. The apparatus of claim 8 wherein the triangular cross-section of said radially projected members increases radially.

12. The apparatus of claim 8 wherein the triangular cross-section of said radially projected members decreases radially.

13. The apparatus of claim 3 wherein the ratio of the height of said radially projecting members measured in a radial direction to the height of said passage means measured in a radial direction is from about 0.1 to 1.0.

14. The apparatus of claim 3 including four radially projecting members.

* * * * *